US005824214A

United States Patent [19]

Paul et al.

[11] Patent Number: 5,824,214

[45] Date of Patent: Oct. 20, 1998

[54] METHOD FOR HYDROTREATING AND UPGRADING HEAVY CRUDE OIL DURING PRODUCTION

[75] Inventors: James M. Paul, DeSoto; R. Michael Davis, Ft. Worth, both of Tex.

[73] Assignee: Mobil Oil Corporation, Fairfax, Va.

[21] Appl. No.: 504,052

[22] Filed: Jul. 11, 1995

[51] Int. Cl.[6] ..... C01G 47/00; E21B 43/00; C01B 53/00; C09K 7/00

[52] U.S. Cl. ..... 208/107; 208/108; 208/124; 208/145; 208/289; 208/370; 422/127; 422/128; 166/247; 166/249; 204/157.15; 204/157.42; 204/157.62; 507/140; 507/143; 507/269; 507/271

[58] Field of Search ..... 208/107, 108, 208/124, 145, 370, 289; 422/127, 128; 166/247, 249; 204/157.62, 157.42, 157.15; 507/140, 143, 271, 269

[56] References Cited

U.S. PATENT DOCUMENTS

| | | | |
|---|---|---|---|
| 3,576,737 | 4/1971 | Mitchell | 208/251 |
| 3,859,199 | 1/1975 | Gatsis | 208/97 |
| 3,876,530 | 4/1975 | Frayer et al. | 208/210 |
| 4,298,460 | 11/1981 | Fujimori et al. | 208/121 |
| 5,110,443 | 5/1992 | Gregoli et al. | 204/157.42 |
| 5,344,532 | 9/1994 | Joseph | 204/157.42 |
| 5,501,778 | 3/1996 | Muller et al. | 204/157.42 |

OTHER PUBLICATIONS

Lin, J–R., et al., "An Upgrading Process through Cavitation and Surfactant," Energy & Fuels, 7, 111–118 (1993) Jun. 1992.

Petrier, C., et al., "Ultrasonically Improved Reductive Properties of an Aqueous Zn–$NiCL_2$ System–1 Selective Reduction of α,β–Unsaturated Carbonyl Compuunds," Tetrahedron Letters, vol. 38, No. 21, 2347–2350 (1987). Month not available.

Boudjouk, P., et al., "Palladium–Catalyzed and Sonically Accelerated Hydrogenations of Olefins Using Formic Acid as a Hydrogen Transfer Agent," Journal of Catalysis, vol. 79, No. 2, 489–492 (1983) Month not available.

Wiener, H.B., et al., "An Effect of Sound of Heterogeneous Catalysis," J. Appl. Chem., 8, 336–341 (1958) May 1958.

*Primary Examiner*—Mark L. Bell
*Assistant Examiner*—Patricia L. Hailey
*Attorney, Agent, or Firm*—Robert B. Furr, Jr.; Malcolm D. Keen

[57] ABSTRACT

Heavy crude oil containing at least 1% by weight water is hydrotreated and upgraded while being produced downhole in a production well. During production the heavy crude oil containing water is subjected to sonic energy at a low frequency of 400 Hz to 10 kHz downhole in the presence of a metal hydrogenation catalyst that causes the water in the crude oil to react and form hydrogen which then hydrotreats and upgrades the heavy crude oil during production. In another embodiment, if the heavy crude oil does not contain water, the hydrogen may be formed in-situ by contacting the heavy crude oil downhole with a chemical compound comprising ammonia, hydrazine and formic acid that in the presence of a metal hydrogenation catalyst and sonic energy causes the chemical compound to react and form hydrogen which then hydrotreats the heavy crude oil during production. Suitable catalysts include nickel on zinc dust, platinum on carbon and palladium on carbon, preferably nickel on zinc dust. The hydrotreated and upgraded heavy crude oil has improved properties making it easier to refine and transport by pipeline. The upgrading includes reducing the amount of asphaltenes and resins in the heavy crude oil and increasing the amount of aromatics and saturates.

41 Claims, 6 Drawing Sheets

METHOD FOR HYDROTREATING AND UPGRADING HEAVY CRUDE OIL DURING PRODUCTION

FIELD OF THE INVENTION

This invention relates to hydrotreating and upgrading heavy crude oil containing water downhole during production by subjecting the heavy crude oil to low frequency sonic energy in the presence of a metal hydrogenation catalyst that causes the water in the crude oil to react and form hydrogen which then hydrotreats and upgrades the heavy crude oil during production. The method of this invention results in upgrading heavy crude oil which improves its flow properties and makes it easier to refine and removes undesirable water.

BACKGROUND OF THE INVENTION

There are many subterranean formations containing heavy, i.e., viscous, oils. Such formations are known to exist in the major tar sand deposits of Alberta, Canada and Venezuela, with lesser deposits elsewhere, for example, in California, Utah and Texas. The API gravity of the oils in these deposits typically ranges from 10° to 6° in the Athabasca sands in Canada to even lower values in the San Miguel sands in Texas, indicating that the oil is highly viscous in nature. Typically, crude from these areas have a metal content of 400–1400 ppm of vanadium (V) plus nickel (Ni), iron and other metals and contain large amounts of water. The high density and viscosity of these crudes make them difficult to transport. In addition, their processing in conventional refineries is not possible.

Crude oils are complex mixtures comprising hydrocarbons of widely varying molecular weights, i.e. from the very simple low molecular weight species including methane, propane, octane and the like to those complex structures whose molecular weights approach 100,000. In addition, sulfur, oxygen and nitrogen containing compounds may characteristically be present. Further, the hydrocarbon constituents may comprise saturated and unsaturated aliphatic species and those having aromatic character.

By a variety of fractionation procedures crude oils can be separated into various classes, the most common of which is boiling range. The mixtures which are in the lower boiling ranges generally consist of materials of relatively simple structures. The mixtures which are in the high boiling point ranges comprise substances which, with the exception of paraffins, are so complex that broad terms are applied to them such as resins and asphaltenes. Resins are poorly characterized but are known to be highly aromatic in character and are generally thought to be high molecular weight polynuclear aromatic hydrocarbons which melt over a wide, elevated temperature range.

Asphaltenes are aromatic-base hydrocarbons of amorphous structure. They are present in crude oils in dispersed particles. The central part of the asphaltene micelle consists of high-molecular weight compounds surrounded and peptized by lower weight neutral resins and aromatic hydrocarbons. Asphaltene content generally increases with decreasing API gravity. The components of asphaltic materials are classified by their physical properties. Neutral resins are soluble in petroleum oils including $C_5$ fractions while the asphaltenes are insoluble in light gasoline and petroleum ether. Ashphaltenes are lyophobic with respect to low-molecular-weight paraffinic hydrocarbons and lyophilic with respect to aromatics and resins. The aromatics and resins peptize the asphaltene particle by adsorption on its surface, resulting in dispersion of the particle in the oil.

Hydrotreatment has been used as a method for upgrading heavy oil and catalysts employed therein include cobalt/molybdenum on alumina and activated carbon, vanadium, nickel and iron. Such hydrotreating methods are disclosed in U.S. Pat. Nos. 3,576,737; 3,859,199; 3,876,530 and 4,298,460.

Various methods have been disclosed to upgrade hydrocarbons with various chemicals coupled with ultrasonic energy. H. B. Weiner and P. W. Young: "An Effect of Sound on Heterogeneous Catalysis", J. Appl. Chem., pp. 336–41 (May, 1958), converted $NH_3$ (15%) and formic acid (50%) to hydrogen using sonic energy at a frequency of 13.5 kHz and passed over a heated nickel wire which hydrogenates $H_2C{=}CH_2$ according to the equation below:

$$H_2C = CH_2 \xrightarrow[NH_3]{)))13.5\ kHz;\ NiWire} H_3C - CH_3$$

P. Boudjouk and B. -H. Han, Journal of Catalysis, Vol. 79, Number 2, pp.489–92 (Feb. 1983) reported that several chemicals can be degraded under ultrasonic energy to produce hydrogen transfer agents: ammonia/nickel wire; formic acid/Pd-C; hydrazine/Pt-C; and water/Zn-Ni catalysts according to the equations below:

$$H_2C = CH_2 \xrightarrow[25°\ C.;\ HCO_2H]{)))30\ kHz;\ Pd/c} H_3C - CH_3$$

$$H_2C = CH_2 \xrightarrow[25°\ C.;\ H_2O]{)))30\ kHz;\ Zn/Ni} H_3C - CH_3$$

Jiunn-Ren Lin and T. F. Yen; "An Upgrading Process Through Cavitation and Surfactant", Energy & Fuels, pp. 111–118, 1993, have studied upgrading reactions with heavy oil, tar sand, coal liquids, etc. with various chemical methods coupled with ultrasound. They have used caustic, sodium silicate, surfactants and hydrogen (sodium borohydride source) to provide considerable upgrading of heavy fractions. The best results were obtained when using hydrogenation and surprisingly, in an emulsion the hydrogen was transferred to asphaltenes and resins to form oils and saturates. Heavy metals (V, Ni, Fe) were removed as well as heteroatoms (sulfur, nitrogen and oxygen). The following equations illustrate the possible chemical transformations:

$$NaBH_4 + 2H_2O\ \text{Span20} \rightarrow 4H_2 \uparrow + NaBO_2$$

$$\text{Asphaltene} \xrightarrow[NaSiO_3]{H_2O_2} H_2 \uparrow + \text{Asphaltene}$$

$$\text{TarSand} \xrightarrow[NaSiO_3]{NaOH} \text{Light Oil}$$

C. Petrico and Jean-Louis Lucke, "Ultrasonically Improved Reduction Properties of an Aqueous Zinc-Nickel System-1 Selective Reduction of α, β-Unsaturated Carbonyl Compounds", Tetrahedron Letters, Vol. 28, No. 21, pp. 2347–2350, 1987, reported conjugate hydrogenation of several compounds, is obtained with good to excellent yield in an aqueous medium using a reagent constituted by zinc dust and nickel chloride with ultrasounds improving the yields and selection rates.

SUMMARY OF THE INVENTION

In accordance with the present invention there is provided a method for hydrotreating and upgrading heavy crude oil containing at least 1% water being produced from a production well penetrating a subterranean, heavy crude oil containing formation comprising subjecting the heavy crude oil produced in the lower portion of the production well to sonic energy in the frequency range of 400 Hz to 10 kHz in the presence of a metal hydrogenation catalyst, preferably nickel on zinc dust, that causes the water in the crude oil to react and form hydrogen which then hydrotreats and upgrades the heavy crude oil during production. In another embodiment the invention can be applied to hydrotreating heavy crude oil during production that does not contain water. In this embodiment, the heavy crude oil being produced in the lower portion of the production well is contacted with a chemical compound comprising ammonia, hydrazine and formic acid to form a mixture and then subjecting the mixture to sonic energy in the frequency range of 400 Hz to 10 kHz and in the presence of a metal hydrogenation catalyst that causes the chemical compound to react and form hydrogen which then hydrotreats the heavy crude oil in-situ. Downhole upgrading of the heavy oil takes advantage of the inherent elevated temperatures and pressures of the formation to enhance the process.

DESCRIPTION OF THE PREFERRED EMBODIMENTS

Figure 1:
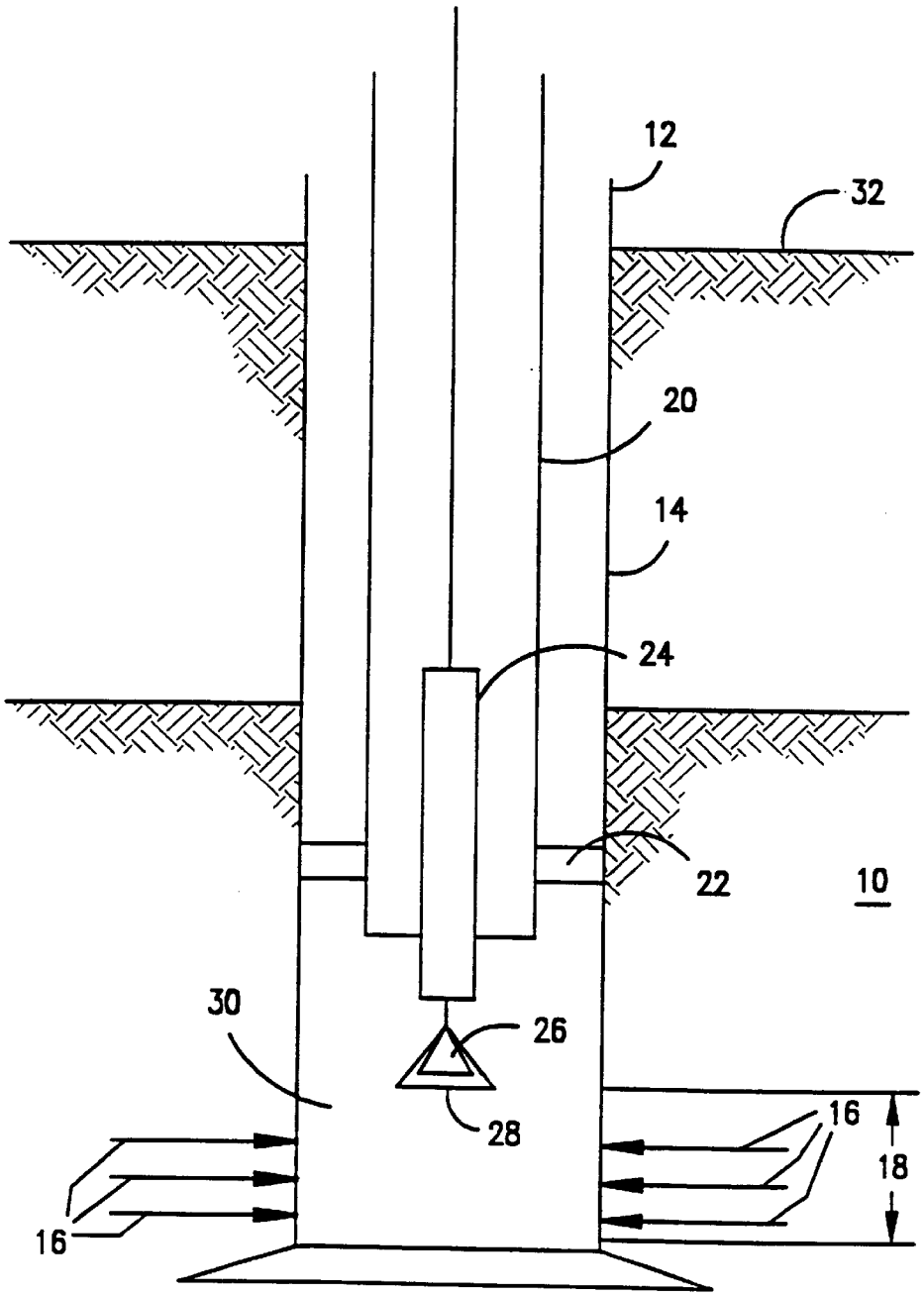
FIG. 1 illustrates the method used in the invention for hydrotreating heavy crude oil that contains water during production by subjecting the heavy crude oil downhole to sonic energy and a metal hydrogenation catalyst that causes the water to react and form hydrogen which then hydrotreats the oil in-situ.

Referring to FIG. 1, there is shown a subterranean, heavy oil-containing formation 10 penetrated by a production well 12 equipped with a casing 14 provided with perforations 16 in the production interval 18 to allow production of oil from the formation.

A production tubing 20 is disposed within the casing 14. A packer 22 seats the production tubing 20 in the casing 14.

In accordance with the present invention, an acoustic transducer 24 and an acoustic driver 26 is positioned in the production tubing 20, preferably just below the tubing, but may be positioned in many different locations depending on the equipment already installed in the well. The acoustic driver 26 is coated with a metal hydrogenation catalyst 28. During production of heavy oil from the formation 10, heavy crude oil containing water enters the casing 14 through perforations 16 and the produced oil and water is conducted to the earth's surface 32 through tubing 20 and finally is conveyed to a suitable hydrocarbon recovery facility. "Heavy crude oil" as used herein is a hydrocarbon crude oil with an API gravity of less than about 20.

The heavy crude oil containing at least 1% by weight water produced in zone 30 is subjected to sonic vibrations having a low frequency in the range of 400 to 10 kHz, preferably about 1.25 kHz, transmitted by transducer 24. The preferred transducer 24 is a transducer manufactured under the trade designation "T"-Motor™ by Sonic Research Corporation, Moline, Ill. The T-Motor™ consists of a magnetostrictive material in the form of rods compressed together and wrapped with a wire coil. The rods comprise 90% iron, 5% terbium and 5% dysprosium sold under the trade designation "Terfenol D" by Edge Technologies, Inc. The Terfenol D rod is the only material known that can produce variable frequency, and withstand high temperature and pressure. The rods vibrate length wise when a DC current flows through the coil. The induced magnetic field causes the rods to expand and contract, i.e. magnetostrictive motion. This motion, or vibration, generates an acoustic wave or sonic energy having a frequency in the range of 10–50 kHz to 400 Hz which extends forward from the T-Motor™ for some distance and the acoustic pressure wave is estimated at a magnitude of 3,000 psi. The T-Motor™ or transducer is powered by a standard frequency generator and a power amplifier. The T-Motor™ is only about 60 cm. in length and about 5 cm. in diameter and can easily be lowered down the production tubing 20 for transmitting sonic energy into zone 32.

As the water in the produced heavy crude oil is brought into contact with the metal hydrogenation catalyst 28 and the low frequency sonic energy at prevailing downhole temperature and pressure it reacts and forms hydrogen which then hydrotreats the heavy crude oil in-situ. The following equation illustrates the chemical transformation that occurs downhole under prevailing downhole formation temperature and pressure:

$$2H_2O \xrightarrow[\text{catalyst}]{)))} 2H_2 + O_2$$

The generated hydrogen in zone 30 reacts with high molecular weight fractions of the heavy oil resulting in downhole heavy crude oil upgrading. Upgrading at the bottom of the production tubing 20 is advantageous because the high gravity or viscosity of the oil is reduced so that less energy is required to flow the oil. In addition, hydrotreating results in releasing the heavy metals (V, Ni, Fe) and non-carboneous materials (S, N, O) from the oil. Asphaltene and resins and the heavy ends are converted to lower molecular weight aromatics and saturates. This conversion results in a higher grade of crude oil which not only has improved flow properties for transmission through a pipeline, but is easier to refine. For example, there is a 1.0 to 1.5 cent increase in price per barrel for heavy crude oil for each tenth degree of API gravity above 20° API to 40.0° API. In addition to the upgrading reactions in the heavy oil, excess hydrogen and co-produced nitrogen or carbon dioxide gases can provide artificial lift for the oil. As the gas-heavy oil mixture is traveling up the production tubing, additional reaction time is provided for upgrading or hydrotreating. The generation of hydrogen from the water in the heavy crude oil also has the added advantage of removing undesirable water from the crude oil.

The catalyst composition employed in the present invention comprises a metal of Group VIII on a finely divided support, preferably nickel on zinc dust. The catalyst may also be contained in a small porous reactor bed located below the acoustic driver 26 in zone 30.

The nickel on zinc catalyst was prepared by mixing zinc dust with an aqueous solution of nickel chloride. The water is filtered off and nickel/zinc catalyst is removed.

Hydrotreating is carried out at prevailing downhole temperature and pressure and a weight hourly space velocity (WHSV) of from about 1 to 300 $hour^{-1}$, preferably 200–250 $hour^{-1}$ in the presence of sonic energy at a frequency in the range of 400 to 10 kHz, preferably about 1.25 kHz. High space velocities are desirable because it is difficult to position large amounts of metal hydrogenation catalyst downhole.

The practice of the invention is demonstrated further by reference to the following examples which are provided for the purpose of illustration and are not to be construed as limiting the invention.

EXAMPLE 1

A Battrum heavy crude oil emulsion containing about 40% by volume water was hydrotreated and upgraded wherein the conditions in the hydrotreating reaction zone were as follows: 50° C., 100 psig argon pressure, 2.4 g nickel on zinc catalyst/140 ml heavy crude oil emulsion, sonic energy at a frequency of 1.25 kHz and a reaction time of 15 minutes. This corresponds to a WHSV of about 233 $hour^{-1}$.

Samples of the raw heavy crude oil and hydrotreated product were analyzed to determine critical characteristics (asphaltenes, resins, aromatics and saturates) by subjecting the samples to chromatographic separation by a technique based upon Thin Layer Chromatography (TLC) combined with flame-ionization detection (FID). The TLC technique is used to chromatographically separate the high molecular weight incompatible asphaltenes and the lower molecular weight oil fractions and compatible components. TLC-FID analysis is a well known technique as described in "An Upgrading Process through Cavitation and Surfactant" Lin and Yen, Energy and Fuels, 1993, pgs. 111–118 and in a book by Joseph C. Touchstone and M. F. Dobbins entitled "Practice of Thin Layer Chromatography", published by Wiley-Interscience, 1978, which are incorporated herein by reference in their entirety. In the present invention small samples of the raw crude oil and hydrotreated crude oil were spotted on silica covered quartz rods and individual components were separated sequentially by three solvents. After the components were separated chromotraphically, the rods were scanned in a special instrument, Iatroscan, and the individual spots were vaporized in a hydrogen flame and detected by a flame-ionization detector (FID).

Figure 2:
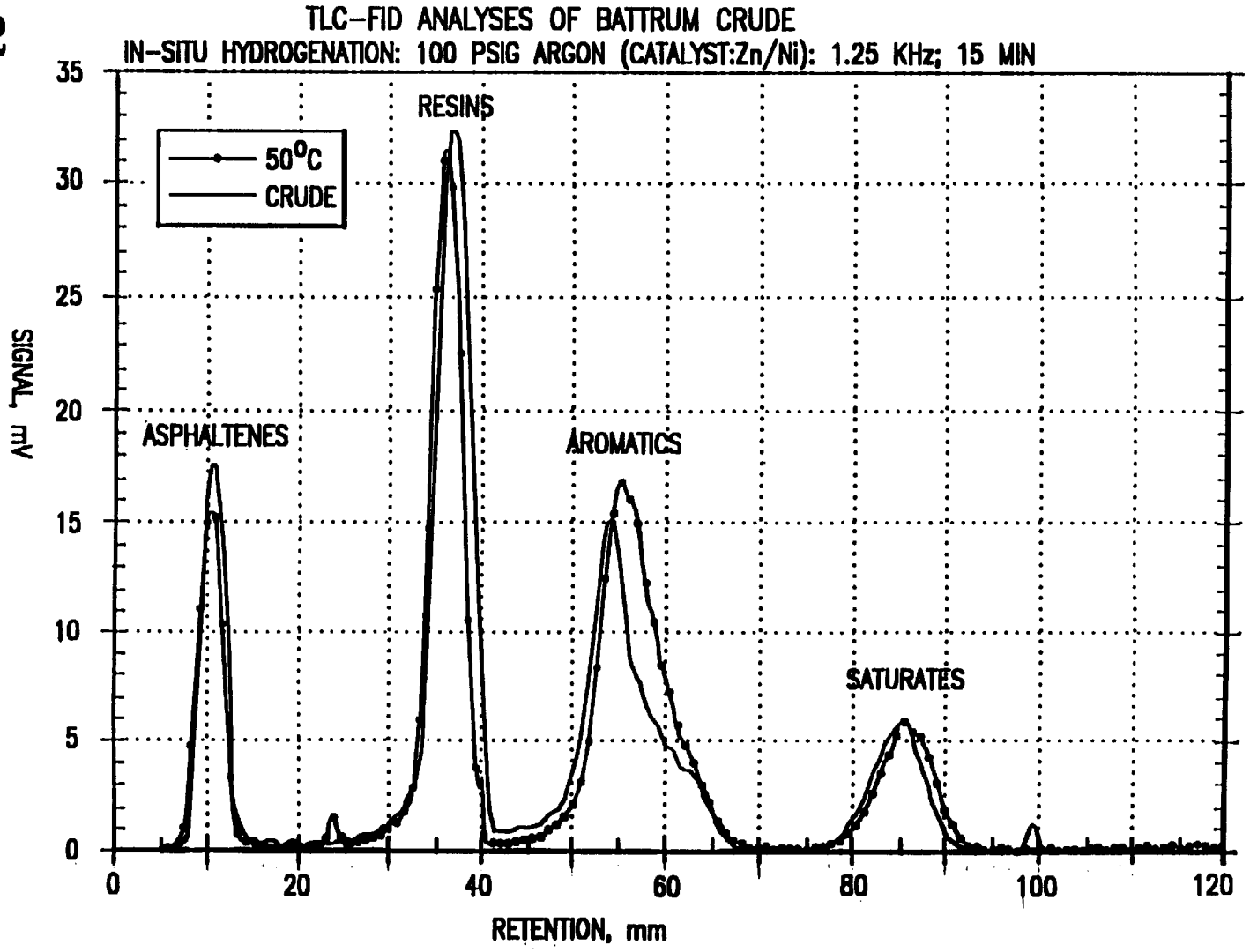
FIG. 2 shows the TLC-FID chromatograph of the Example 1 product and raw crude.

The critical characteristics (asphaltene, resins, aromatics and saturates) of the raw crude oil and hydrotreated crude oil based upon the TLC-FID analysis are shown in Table 1. The TLC-FID chromatograph is shown in FIG. 2. The results in Table 1 show that the amount of asphaltenes decreased from 16.19% to 14.69% by weight, the amount of resin decreased from 41.38% to 36.71% by weight and the amount of aromatics increased from 30.95% to 36.88% by weight and the amount of saturates increased from 11.48% to 11.71% by weight thereby resulting in an upgraded crude oil.

TABLE 1

Hydrotreating Battrum Crude and Changes of Critical Characteristics

| | Raw Crude (wt. %) | Hydrotreated (wt. %) |
|---|---|---|
| Asphaltenes | 16.19 | 14.69 |
| Resin | 41.38 | 36.71 |
| Aromatics | 30.95 | 36.88 |
| Saturates | 11.48 | 11.71 |

Gas analyses for the above hydrotreating reaction are shown in Table 2. The gas analysis results in Table 2 estimates how much, if any, hydrogen and oxygen are produced. The results in Table 2 show that some of the hydrogen is being used in the reaction with the oil, since the observed ratio between oxygen and hydrogen is not stoichiometric for the degradation of water. The two values listed for hydrogen are simply two different types of detectors.

TABLE 2

Gas Analysis

| Mole % | 100 psig |
|---|---|
| H2 (DID) | 1.03 |
| H2 (USD) | 1.01 |
| O2 (USD) | 0.25 |

EXAMPLE 2

Figure 3:
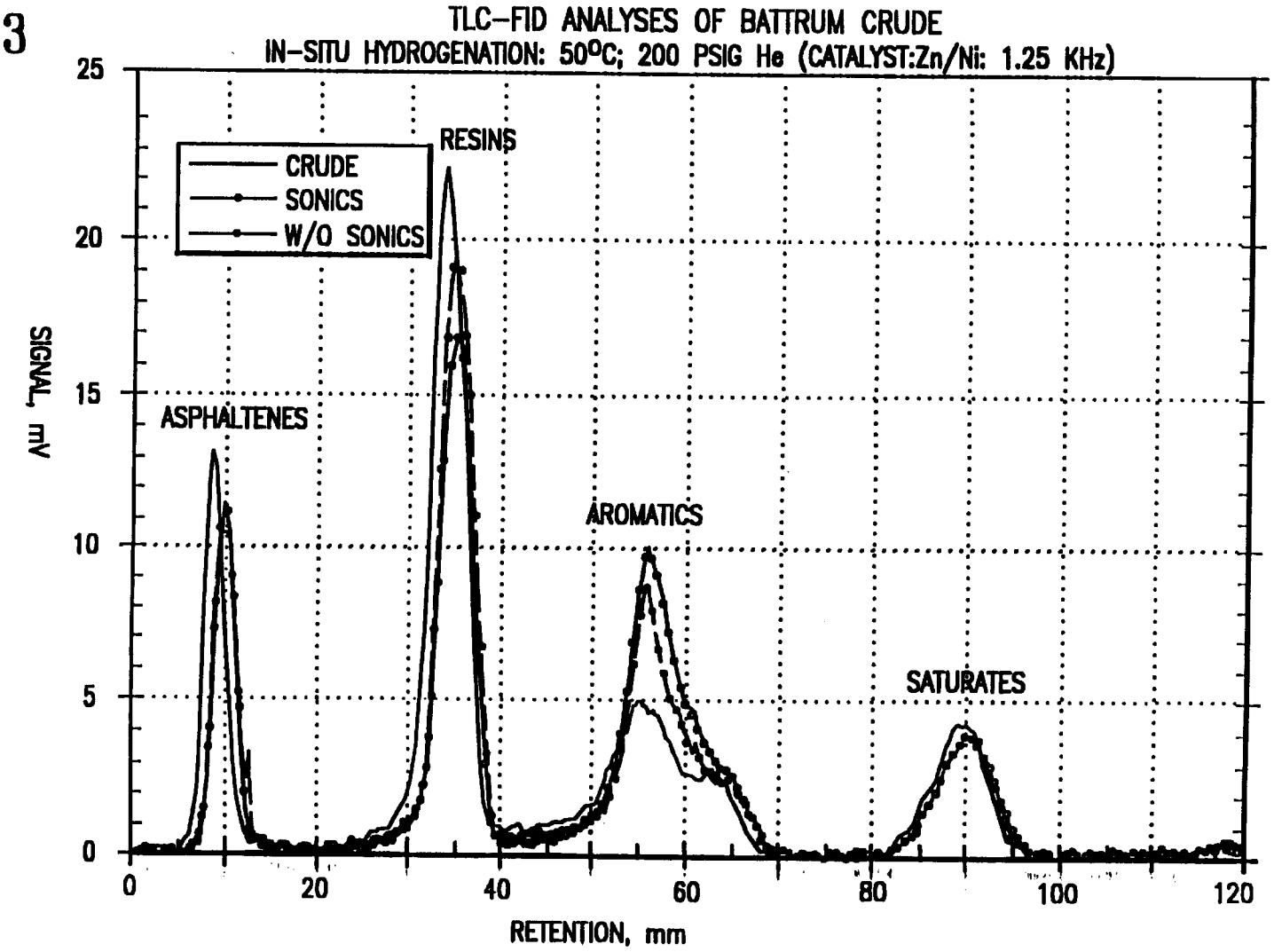
FIG. 3 shows the TLC-FID chromatograph of the Example 2 product and raw crude.

A Battrum heavy crude oil emulsion containing about 40% by volume water was hydrotreated and upgraded wherein the conditions in the hydrotreating reaction zones were as follows: 50° C., 200 psig helium pressure, 2.4 g nickel on zinc catalyst/150 ml crude oil emulsion, sonic energy at a frequency of 1.25 kHz and a reaction time of 15 minutes. This corresponds to a WHSV of about 233 $hour^{-1}$. For comparison, the heavy crude oil emulsion was hydrotreated under the same reaction conditions without sonic energy. The raw crude oil and the hydrotreated crude oil were submitted for TLC-FID analysis which results are shown in Table 3. The TLC-FID chromatograph is shown in FIG. 3. The results in Table 3 show that hydrotreating the crude oil emulsion coupled with sonic energy reduces the amount of asphaltenes in the crude oil from 16.9% to 15.5% by weight, reduces the amount of resin from 47.1% to 34.1% by weight, increases the amount of aromatics from 21.6% to 36.7% by weight and slightly decreases the amount of saturates from 14.3% to 13.7% by weight. The results in Table 3 show that hydrotreating the crude oil emulsion at the same reaction hydrogenation conditions without sonic energy reduces the amount of asphaltenes from 16.9% to 16.0% by weight, reduces the amount of resin from 47.11% to 40.7% by weight, increases the amount of aromatics from 21.6% to 30.3% by weight and reduces the amount of saturates from 14.3% to 12.9% by weight. These results show that hydrotreating and upgrading is improved with the use of sonic energy since the percentage change of critical characteristics of the raw crude oil are larger.

TABLE 3

Hydrotreating Battrum Crude and Change of Critical Characteristics

| | Raw Crude (wt. %) | Hydrotreated w/ Sonics (wt. %) | Hydrotreated w/o Sonics (wt. %) |
|---|---|---|---|
| Asphaltenes | 16.9 | 15.5 | 16.0 |
| Resin | 47.1 | 34.1 | 40.7 |
| Aromatics | 21.6 | 36.7 | 30.3 |
| Saturates | 14.3 | 13.7 | 12.9 |

EXAMPLE 3

Figure 4:
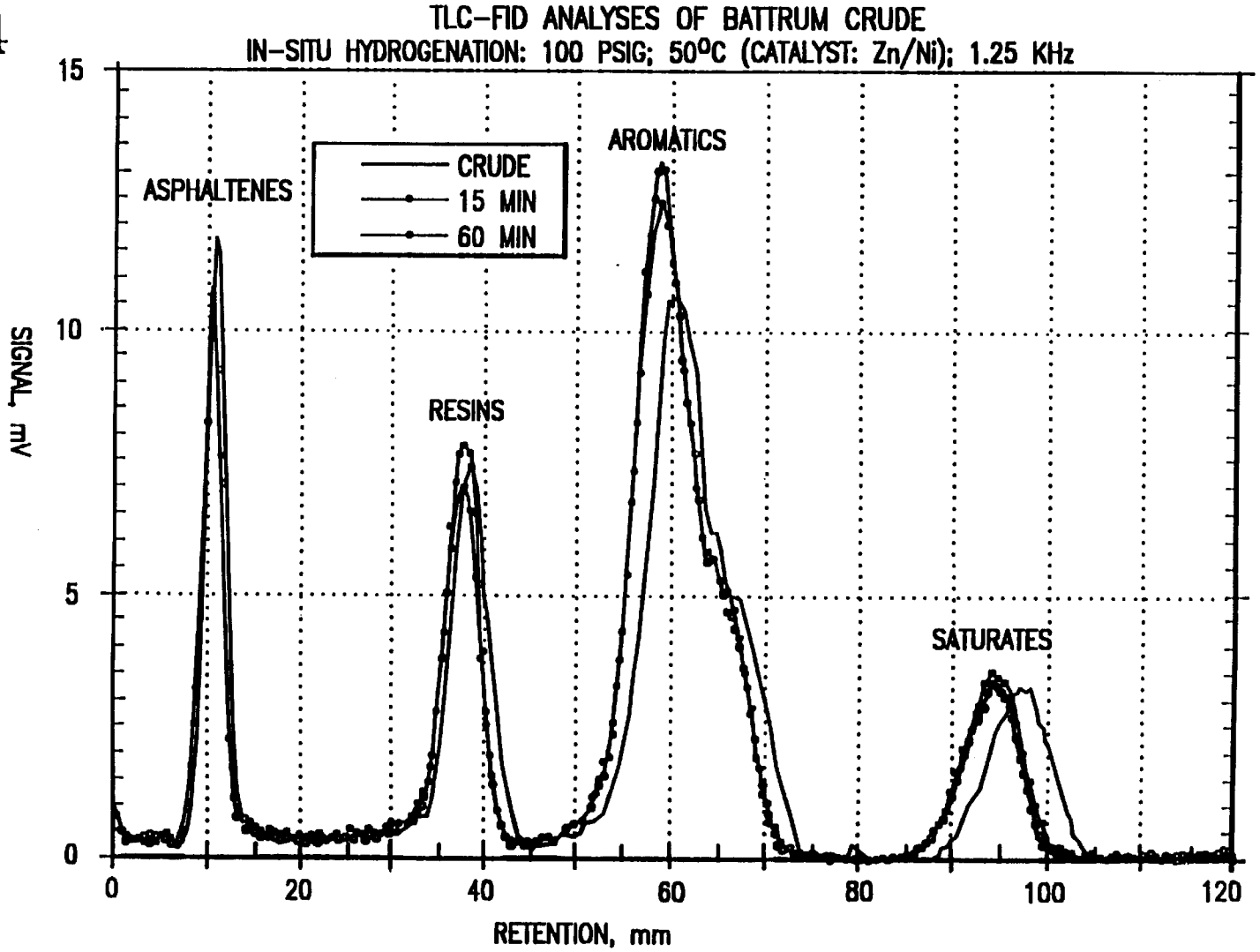
FIG. 4 shows the TLC-FID chromatograph of the Example 3 product and raw crude.

A Battrum heavy crude oil emulsion containing about 40% by volume water was hydrotreated and upgraded wherein the conditions in the hydrotreating reaction zone were as follows: 50° C., 100 psig helium pressure, 5 g nickel on zinc catalyst/150 ml crude oil emulsion, sonic energy at a frequency of 1.25 kHz and reaction times of 15 and 60 minutes. For a reaction time of 15 minutes this corresponds to a WHSV of about 112 $hour^{-1}$. For a reaction time of 60 minutes this corresponds to a WHSV of about 28 $hour^{-1}$. The raw crude oil and hydrotreated crude oil were submitted for TLC-FID analysis which results are shown in Table 4. The TLC-FID chromatograph pattern is shown in FIG. 4. The results in Table 4 show that hydrotreating for a 15 minute reaction time reduces the amount of asphaltenes from 15.6% to 13.4% by weight, the amount of resin decreased from 18.1% to 17.6% by weight, the amount of aromatics increased from 52.9% to 57.2% by weight and a slight decrease in the amount of saturates from 13.4% to 11.8% by weight. The results in Table 4 show that increasing reaction time from 15 to 60 minutes under the same hydrotreating conditions is not especially effective since the critical characteristics of the hydrotreated crude oil for a 15 minute and 60 minute reaction time are almost equivalent. The amount of Ni/Zn catalyst used in the hydrotreating reaction zone for the results shown in Table 4 is almost twice the amount used for the results shown obtained in Table 3. The results show that the amount of catalyst is apparently not critical which means that the Ni/Zn is really acting like a catalyst, although it may actually be a chemical reactant like the water.

TABLE 4

Hydrotreating Battrum Crude and Change of Critical Characteristics

| | Raw Crude (wt. %) | Hydrotreated 15 min. (wt. %) | Hydrotreated 60 min. (wt. %) |
|---|---|---|---|
| Asphaltenes | 15.6 | 13.4 | 13.8 |
| Resin | 18.2 | 17.5 | 15.8 |
| Aromatics | 52.9 | 57.2 | 57.6 |
| Saturates | 13.4 | 11.8 | 12.8 |

In another embodiment of the invention, if the heavy crude oil does not contain sufficient water to generate hydrogen, a chemical compound capable of forming hydrogen in the presence of a catalyst coupled with sonic energy is injected into the heavy crude oil downhole.

Figure 5:
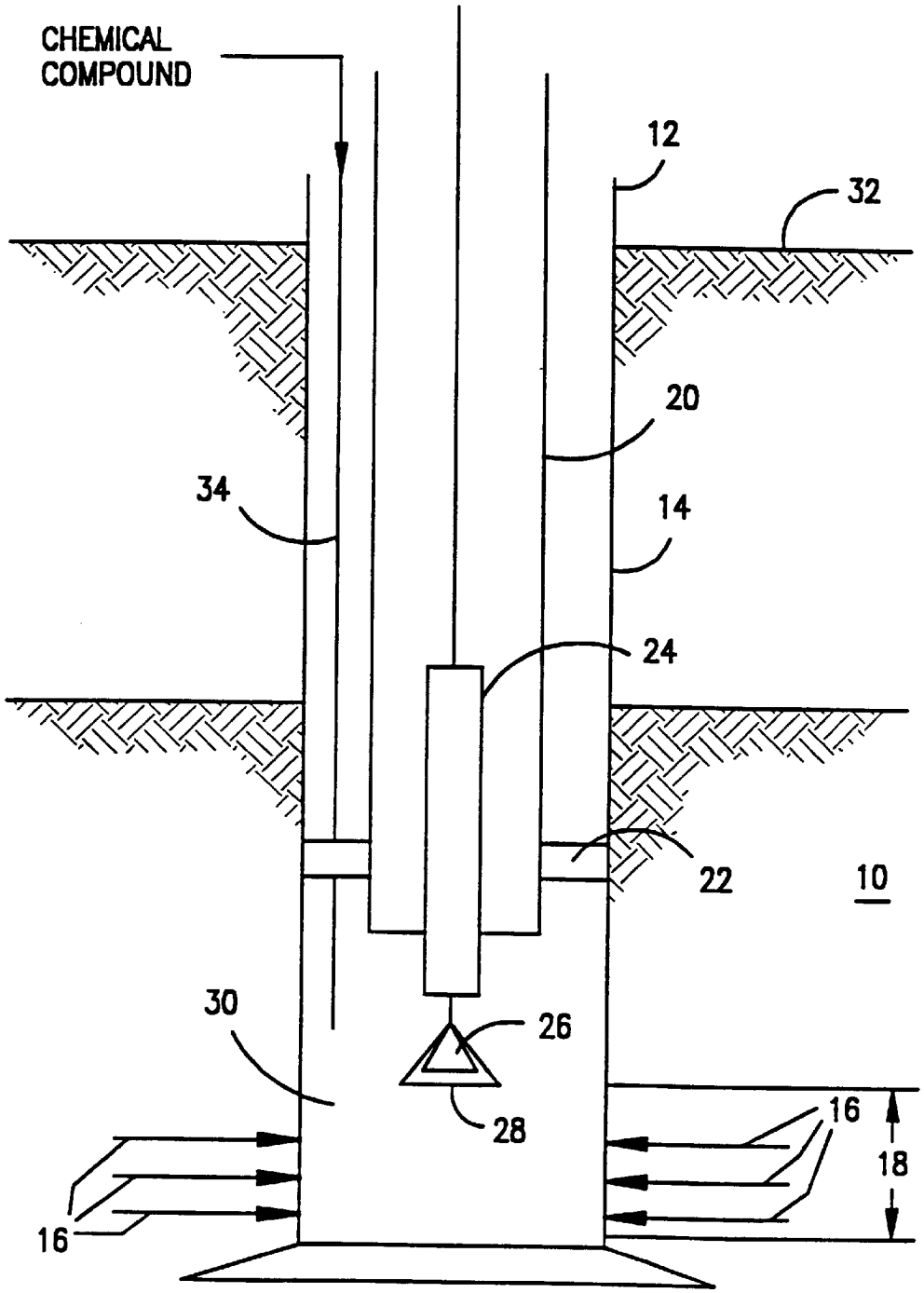
FIG. 5 shows another method for hydrotreating heavy crude oil during production by injecting a chemical into the heavy crude oil downhole coupled with sonic energy and a metal hydrogenation catalyst.

Referring to FIG. 5, during production of the heavy crude oil a chemical compound such as ammonia gas (or aqueous ammonia), hydrazine or formic acid is injected via tubing 34 into zone 32 of the well 12 that co-mingles with the heavy crude oil being produced from the adjacent production interval 18. The amount of ammonia, hydrazine or formic acid injected into zone 30 will be equal to or greater than 1% of the total volume of the produced heavy crude oil from the downhole equipment. During injection of the chemical compound sonic vibrations having a low frequency in the range of 400 to 10 kHz, preferably about 1.25 kHz, are transmitted into zone 32 by transducer 24. As the ammonia, hydrazine or formic acid is continually brought into contact with the produced crude oil under the influence of the low frequency sonic energy, and in the presence of a metal hydrogenation catalyst 28 at the prevailing downhole formation temperatures and pressures, it reacts to form hydrogen which then hydrotreats the heavy crude oil in-situ. The catalyst composition comprises a metal from Group VIII on a finely divided support including nickel on zinc, platinum on carbon and palladium on carbon, preferably nickel on zinc. The following equations illustrates the chemical transformations that occur downhole under the influence of the low frequency sonic energy depending upon the specific chemical injected into the heavy crude oil:

$$\text{(ammonia)}2NH_3 \xrightarrow[\text{catalyst}]{)))} 3H_2 + N_2$$

$$\text{(hydrazine)}H_2NNH_2 \xrightarrow[\text{catalyst}]{)))} 2H_2 + N_2$$

$$\text{(formic acid)}HCOOH \xrightarrow[\text{catalyst}]{)))} H_2 + CO_2$$

Figure 6:
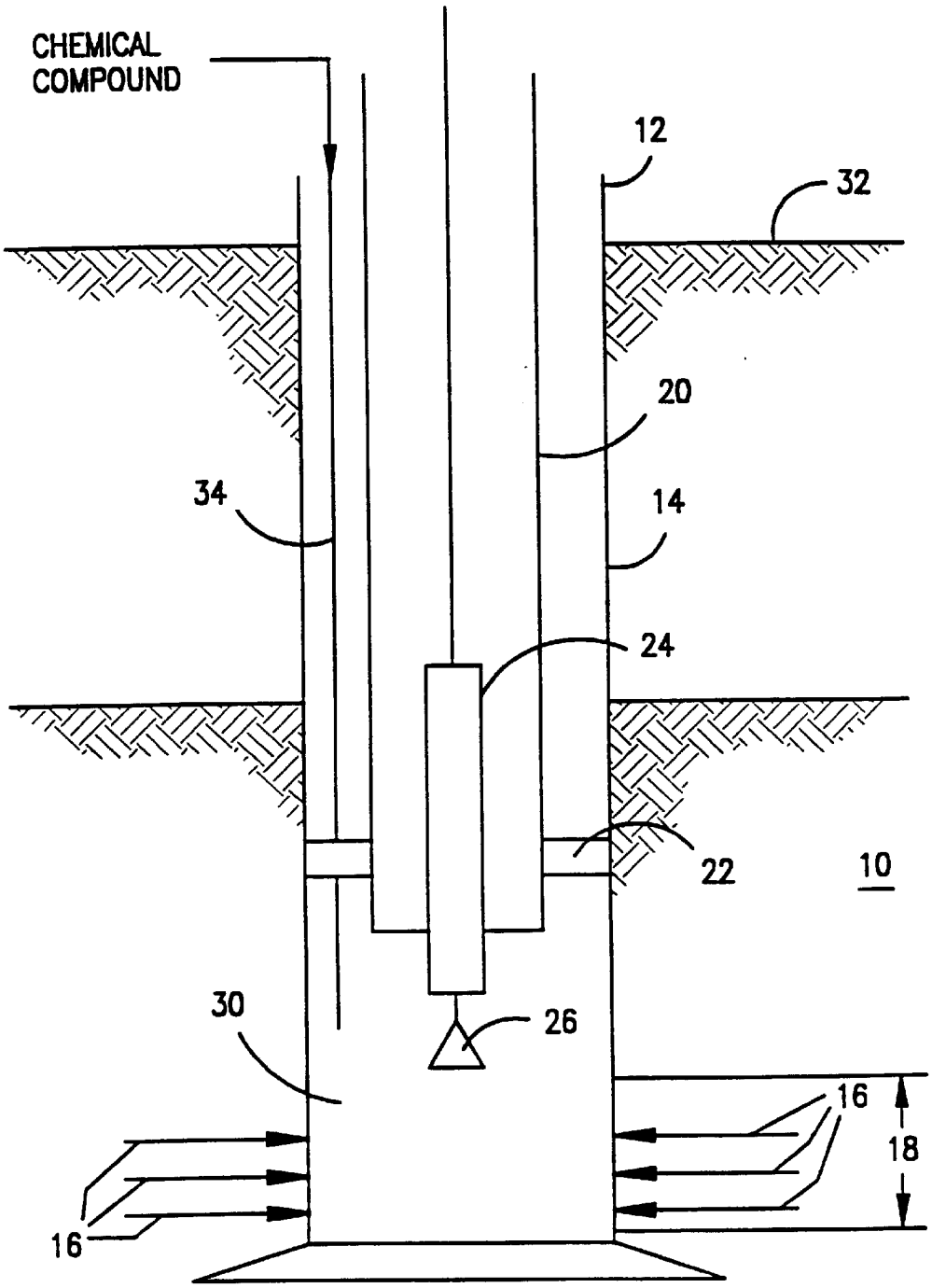
FIG. 6 shows still another method for generating hydrogen in-situ by injecting a chemical into the heavy crude oil downhole coupled with sonic energy and catalytic metals presence in the heavy crude oil being produced from the well.

In still another embodiment of the invention, the heavy crude oil may contain a high concentration of metals such as vanadium, nickel, iron and other metals that act as a catalyst in generating hydrogen from the chemical compound such as ammonia, hydrazine or formic acid injected into the produced heavy crude oil coupled with sonic energy in the frequency range of 400 to 10 kHz. In this embodiment, it is not necessary to provide a catalyst because the metals contained in the heavy crude oil act as a hydrogenation catalyst. Referring to FIG. 6, during production of the heavy oil containing a high concentration of metals, preferably at least 200 ppm metals such as vanadium, nickel and iron, a chemical compound such as ammonia gas (or aqueous ammonia), hydrazine or formic acid is injected via tubing 34 into zone 32 of the well 12 and co-mingle with the heavy crude oil being produced from the adjacent production interval 18. The amount of ammonia, hydrazine or formic acid injected into zone 32 will be equal to or greater than 1% of the volume of the amount of heavy oil produced from the downhole equipment. During injection of the chemical compound sonic vibrations having a low frequency in the range of 400 to 10 kHz, preferably about 1.25 kHz, are transmitted into zone 32 by transducer 24. The ammonia, hydrazine or formic acid, under the influence of the low frequency sonic energy, and in the presence of the vanadium, nickel, iron and other metals contained in the heavy crude oil and at the prevailing downhole formation temperatures and pressures, react to form hydrogen which then hydrotreats the heavy crude oil in-situ. The following equations illustrates the chemical transformations that occur downhole under the influence of the low frequency sonic energy depending upon the specific chemical injected into the heavy crude oil:

$$\text{(ammonia)}2NH_3 \xrightarrow[\text{metals in heavy oil}]{)))} 3H_2 + N_2$$

$$\text{(hydrazine)}H_2NNH_2 \xrightarrow[\text{metals in heavy oil}]{)))} 2H_2 + N_2$$

$$\text{(formic acid)}HCOOH \xrightarrow[\text{metals in heavy oil}]{)))} H_2 + CO_2$$

In another embodiment of the invention, the upgrading process may also be conducted upstream or in the surface facilities at room temperature and atmospheric pressure or at temperatures and pressures higher than ambient conditions and the finely divided metal hydrogenation catalyst may be used in a reactor bed. For example, the transducer may be installed in surface delivery lines before or after tanks or water break out vessels. The reactants may be metered into the lines in the same manner as in the downhole case described above.

Obviously, many other variations and modifications of this invention as previously set forth may be made without departing from the spirit and scope of this invention as those skilled in the art readily understand. Such variations and modifications are considered part of this invention and within the purview and scope of the appended claims.

What is claimed is:

1. A method for hydrotreating and upgrading heavy crude oil containing at least 1% weight water and having less than 20 degree API gravity in a production well penetrating a subterranean, heavy crude oil containing formation comprising:

producing heavy crude oil from the formation; subjecting the heavy crude oil containing water downhole in the production well to sonic energy in the frequency range of 400 to 10 kHz at prevailing downhole temperature and pressure in the presence of a metal hydrogenation catalyst to cause the water in the crude oil to react and form hydrogen in-situ in the production well, wherein the hydrogen is formed according to the equation below:

$$2H_2O \xrightarrow{>>>} \xrightarrow[\text{catalyst}]{} 2H_2 + O_2,$$

and is formed in the absence of hydrazine: hydrotreating the heavy crude oil in-situ in the production well with the hydrogen to form an upgraded, hydrotreated oil of lower gravity and viscosity than the heavy crude oil.

2. The method as recited in claims wherein the frequency is 1.25 kHz.

3. The method as recited in claim 1 wherein the catalyst is a Group VIII metal on a finely divided support.

4. The method as recited in claim 3 wherein the catalyst is nickel on zinc dust.

5. The method as recited in claim 1 wherein the hydroteatment is conducted at a space velocity of about 1 to about 300 $hour^{-1}$.

6. A method for hydrotreating and upgrading heavy crude oil containing at least 200 ppm metals and having less than 20 degree API gravity in a production well penetrating a subterranean, heavy crude oil containing formation comprising:

a) producing heavy crude oil from the formation into the production well; and b) contacting the heavy crude oil downhole in the production well with at least 1 percent by weight of hydrazine, based on the total volume of heavy crude oil, to form a mixture of heavy crude oil and hydrazine, subjecting the mixture of hydrazine and heavy crude oil to sonic energy in the frequency range of about 400 to 10 kHz at prevailing downhole conditions of temperature and pressure in the well in the presence of the metals in the crude oil that act as a hydrogenation catalyst, to cause the hydrazine to react and form hydrogen in-situ in the production well, wherein the hydrogen is formed according to the equation below:

$$(\text{hydrazine})H_2NNH_2 \xrightarrow{>>>} \xrightarrow[\text{metals in heavy oil}]{} 2H_2 + N_2$$

hydrotreating the heavy crude oil with the hydrogen to form an upgraded, hydrotreated oil of lower gravity and viscosity than the heavy crude oil.

7. The method as recited in claim 6 wherein the heavy crude oil contains a combined total of at least 200 ppm vanadium (V) plus nickel (Ni).

8. The method as recited in claim 6 wherein the metals comprise vanadium, nickel and iron.

9. The method as recited in claim 6 wherein the frequency is 1.25 kHz.

10. A method for hydrotreating and upgrading a heavy crude oil containing at least 200 ppm metals and having less than 20 degree API gravity in-situ downhole in a production well extending from the surface of the earth into a subterranean formation containing the heavy crude oil comprising contacting the heavy crude oil in-situ in the production well with hydrazine to form a mixture of hydrazine and heavy crude oil;

subjecting the mixture of heavy crude oil and hydrazine to sonic energy in the low frequency range of 400 to 10 kHz at the prevailing downhole temperature and pressure in the production well in the presence of the metals in the crude oil that act as a hydrogenation catalyst to cause the hydrazine to react and form hydrogen in-situ in the production well, wherein the hydrogen is formed according to the equation below:

$$(\text{hydrazine})H_2NNH_2 \xrightarrow{>>>} \xrightarrow[\text{metals in heavy oil}]{} 2H_2 + N_2$$

hydrotreating the heavy crude oil with the hydrogen in-situ in the production well to form an upgraded, hydrotreated oil of lower gravity and viscosity than the heavy crude oil.

11. The method as recited in claim 10 wherein the metals comprise a combined total of at least 200 ppm vanadium (V) plus nickel (Ni).

12. The method as recited in claim 10 wherein the metals comprise vanadium, nickel and iron.

13. The method as recited in claim 10, wherein the frequency is 1.25 kHz.

14. A method for hydrotreating and upgrading heavy crude oil having less than 20 degree API gravity being produced from a production well penetrating a subterranean, heavy crude oil containing formation comprising:

producing oil from the formation via the production well; and contacting the heavy crude oil being produced within the production well downhole with ammonia to form a mixture of ammonia and heavy crude oil and subjecting the mixture to sonic energy in the frequency range of about 400 to 10 kHz in the presence of a metal hydrogenation catalyst and at prevailing downhole conditions of temperature and pressure that causes the ammonia to react and form hydrogen which then hydrotreats the heavy crude oil in-situ, said hydrogen formed according to the equation below:

$$(\text{ammonia})NH_3 \xrightarrow{>>>} \xrightarrow[\text{catalyst}]{} 3H_2 + N_2.$$

15. The method as recited in claim 14 wherein the catalyst comprises nickel on zinc, platinum on carbon and palladium on carbon.

16. The method as recited in claim 14 wherein the frequency is 1.25 kHz.

17. A method for hydrotreating and upgrading heavy crude oil having less than 20 degree API gravity being produced from a production well penetrating a subterranean, heavy crude oil containing formation comprising:

producing oil from the formation via the production well; and contacting the heavy crude oil being produced within the production well downhole with formic acid to form a mixture of formic acid and heavy crude oil and subjecting the mixture to sonic energy in the frequency range of about 400 Hz to 10 kHz in the presence of a metal hydrogenation catalyst and at prevailing downhole conditions of temperature and pressure that causes the formic acid to react and form hydrogen which then hydrotreats the heavy crude oil in-situ, said hydrogen formed according to the equation below:

$$\text{(formicacid)HCOOH} \xrightarrow{>>>} \xrightarrow[\text{catalyst}]{} H_2 + CO_2.$$

18. The method as recited in claim 17 wherein the catalyst comprises nickel on zinc, platinum on carbon and palladium on carbon.

19. The method as recited in claim 17, wherein the frequency is 1.25 kHz.

20. A method for hydrotreating and upgrading heavy crude oil containing at least 200 ppm metals and having less than 20 degree API gravity being produced from a production well penetrating a subterranean, heavy crude oil containing formation comprising:

producing heavy crude oil from the formation via the production well; and contacting the heavy crude oil downhole being produced within the production well with ammonia to form a mixture of ammonia and heavy crude oil and subjecting the mixture to sonic energy in the frequency range of about 400 to 10 kHz at prevailing downhole conditions of temperature and pressure and in the presence of the metals in the crude oil that act as a hydrogenation catalyst that causes the ammonia to react and form hydrogen which then hydrotreats the heavy crude oil in-situ, said hydrogen formed according to the equation below:

$$\text{(ammonia)}NH_3 \xrightarrow{>>>} \xrightarrow[\text{metals in heavy oil}]{} 3H_2 + N_2.$$

21. The method as recited in claim 20 wherein the heavy crude oil contains a combined total of at least 200 ppm vanadium (V) plus nickel (Ni).

22. The method as recited in claim 20 wherein the metals comprise vanadium, nickel and iron.

23. The method as recited in claim 20 wherein the frequency is 1.25 kHz.

24. A method for hydrotreating and upgrading heavy crude oil containing at least 200 ppm metals and having less than 20 degree API gravity being produced from a production well penetrating a subterranean, heavy crude oil containing formation comprising:

producing heavy crude oil from the formation via the production well; and contacting the heavy crude oil downhole being produced within the production well with formic acid to form a mixture of formic acid and heavy crude oil and subjecting the mixture to sonic energy in the frequency range of about 400 Hz to 10 kHz at prevailing downhole conditions of temperature and pressure and in the presence of the metals in the crude oil that act as a hydrogenation catalyst that causes the formic acid to react and form hydrogen which then hydrotreats the heavy crude oil in-situ, said hydrogen formed according to the equation below:

$$\text{(formicacid)HCOOH} \xrightarrow{>>>} \xrightarrow[\text{metals in heavy oil}]{} H_2 + CO_2.$$

25. The method as recited in claim 24 wherein the heavy crude oil contains a combined total of at least 200 ppm vanadium (V) plus nickel (Ni).

26. The method as recited in claim 24 wherein the metals comprise vanadium,nickel and iron.

27. The method as recited in claim 24 wherein the frequency is 1.25 kHz.

28. A method for hydrotreating and upgrading a heavy crude oil containing at least 200 ppm metals and having less than 20 degree API gravity comprising contacting the heavy crude oil with ammonia to form a mixture of ammonia and heavy crude oil and subjecting the mixture to sonic energy in the frequency range of about 400 to 10 kHz at room temperature and atmospheric pressure and in the presence of the metals in the crude oil that act as a hydrogenation catalyst that causes the ammonia to react and form hydrogen which then hydrotreats the heavy crude oil in-situ, said hydrogen formed according to the equation below:

$$\text{(ammonia)}NH_3 \xrightarrow{>>>} \xrightarrow[\text{metals in heavy oil}]{} 3H_2 + N_2.$$

29. The method as recited in claim 28 wherein the metals comprise a combined total of at least 200 ppm vanadium (V) plus nickel (Ni).

30. The method as recited in claim 28 wherein the metals comprise vanadium, nickel and iron.

31. The method as recited in claim 28 wherein the frequency is 1.25 kHz.

32. A method for hydrotreating and upgrading a heavy crude oil containing at least 200 ppm metals and having less than 20 degree API gravity comprising contacting the heavy crude oil with formic acid to form a mixture of formic acid and heavy crude oil and subjecting the mixture to sonic energy in the low frequency range of about 400 to 10 kHz and in the presence of the metals in the crude oil that act as a hydrogenation catalyst that causes the formic acid to react and form hydrogen which then hydrotreats the heavy crude oil in-situ, said hydrogen formed according to the equation below:

$$\text{(formicacid)HCOOH} \xrightarrow{>>>} \xrightarrow[\text{metals in heavy oil}]{} H_2 + CO_2.$$

33. The method as recited in claim 32 wherein the metals comprise a combined total of at least 200 ppm vanadium (V) plus nickel (Ni).

34. The method as recited in claim 32 wherein the metals comprise vanadium, nickel and iron.

35. The method as recited in claim 32 wherein the frequency is 1.25 kHz.

36. A method for hydrotreating and upgrading a heavy crude oil having less than 20 degree API gravity comprising contacting the heavy crude oil with ammonia to form a mixture of ammonia and heavy crude oil and subjecting the mixture to sonic energy in the low frequency range of 400 to 10 kHz and in the presence of a metal hydrogenation catalyst at room temperature and atmospheric pressure that causes the ammonia to react and form hydrogen which then hydrotreats the heavy crude oil in-situ, said hydrogen formed according to the equation below:

$$\text{(ammonia)}NH_3 \xrightarrow{>>>} \xrightarrow[\text{catalyst}]{} 3H_2 + N_2.$$

37. The method as recited in claim 36 wherein the catalyst comprises nickel on zinc, platinum on carbon and palladium on carbon.

38. The method as recited in claim 36 wherein the frequency is 1.25 kHz.

39. A method for hydrotreating and upgrading a heavy crude oil having less than 20 degree API gravity comprising contacting the heavy crude oil with formic acid to form a mixture of formic acid and heavy crude oil and subjecting the mixture to sonic energy in the low frequency range of 400 to 10 kHz and in the presence of a metal hydrogenation catalyst at room temperature and atmospheric pressure that causes the formic acid to react and form hydrogen which then hydrotreats the heavy crude oil in-situ, said hydrogen formed according to the equation below:

$$\text{(formicacid)HCOOH} \xrightarrow{>>>} \xrightarrow[\text{catalyst}]{} H_2 + CO_2.$$

40. The method as recited in claim 39 wherein the catalyst comprises nickel on zinc, platinum on carbon and palladium on carbon.

41. The method as recited in claim 39 wherein the frequency is 1.25 kHz.

* * * * *